US008607704B2

(12) United States Patent
Stark et al.

(10) Patent No.: US 8,607,704 B2
(45) Date of Patent: Dec. 17, 2013

(54) METHOD FOR ELECTRICAL FLASHOVER IGNITION AND COMBUSTION OF PROPELLENT CHARGE, AS WELL AS PROPELLENT CHARGE AND AMMUNITION SHOT IN ACCORDANCE THEREWITH

(75) Inventors: Ola Stark, Hammaro (SE); Lennart Gustavsson, Karlskoga (SE); Johan Dahlberg, Port Melbourne (AU); Lars-Peter Svanberg, Solna (SE)

(73) Assignee: BAE Systems Bofors AB, Karlskoga (SE)

( * ) Notice: Subject to any disclaimer, the term of this patent is extended or adjusted under 35 U.S.C. 154(b) by 166 days.

(21) Appl. No.: 12/934,154

(22) PCT Filed: Mar. 23, 2009

(86) PCT No.: PCT/SE2009/000151

§ 371 (c)(1),
(2), (4) Date: Apr. 6, 2011

(87) PCT Pub. No.: WO2009/123528

PCT Pub. Date: Oct. 8, 2009

(65) Prior Publication Data

US 2011/0174184 A1 Jul. 21, 2011

(30) Foreign Application Priority Data

Apr. 1, 2008 (SE) ..... 0800729

(51) Int. Cl.

| | |
|---|---|
| ***F42B 5/16*** | (2006.01) |
| ***C06D 5/00*** | (2006.01) |
| ***C06B 45/18*** | (2006.01) |

(52) U.S. Cl.

USPC ..... 102/202.8; 102/202; 102/289; 102/430

(58) Field of Classification Search

USPC ..... 102/430, 200, 202, 202.5, 200.8, 102/202.11, 206, 289

See application file for complete search history.

(56) References Cited

U.S. PATENT DOCUMENTS

| | | | | |
|---|---|---|---|---|
| 677,527 | A | 7/1901 | Maxim | |
| 3,299,812 | A | 1/1967 | Suh et al. | |
| 3,434,426 | A * | 3/1969 | De Dapper | 102/202.8 |
| 5,854,439 | A * | 12/1998 | Almstrom et al. | 89/8 |
| 6,237,494 | B1 * | 5/2001 | Brunet et al. | 102/202.7 |
| 6,332,402 | B1 | 12/2001 | Weise et al. | |
| 6,745,697 | B2 * | 6/2004 | Haak et al. | 102/472 |
| 7,507,308 | B2 * | 3/2009 | Dahlberg et al. | 149/109.6 |
| 8,464,640 | B2 * | 6/2013 | Sawka | 102/291 |

FOREIGN PATENT DOCUMENTS

| | | | |
|---|---|---|---|
| SE | 509310 | C2 | 1/1999 |
| WO | WO-02083602 | A1 | 10/2002 |

* cited by examiner

*Primary Examiner* — James Bergin

(74) *Attorney, Agent, or Firm* — Novak Druce Connolly Bove + Quigg LLP

(57) ABSTRACT

The invention relates to a method of, in the electrical ignition of a propellent charge (1) provided with an electrically conductive surface coating (5) and comprising one or more propellant components (3), ensuring that ignition and progressive combustion of the propellent charge take place. The method is characterized in that said electrically conductive surface coating, when ignition of the propellent charge is desired, is connected to an electrical high-voltage source (6), in that said high-voltage source is made to generate at least one high electrical pulse to said connected electrically conductive surface coating, and in that said at least one high electrical pulse produces an instantaneous flashover ignition of the electrically conductive surface coating of the propellent charge and of all its propellant components, simultaneously. The invention also relates to a propellent charge and to an ammunition shot comprising the propellent charge.

15 Claims, 3 Drawing Sheets

Figure 1:
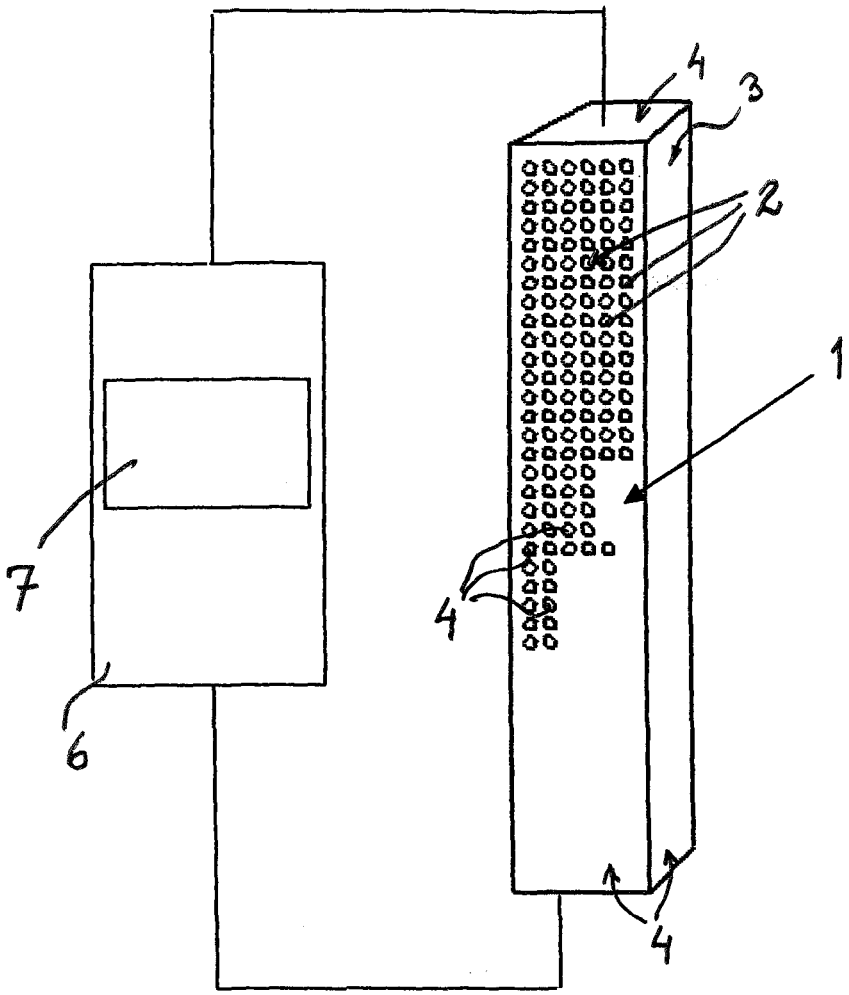

METHOD FOR ELECTRICAL FLASHOVER IGNITION AND COMBUSTION OF PROPELLENT CHARGE, AS WELL AS PROPELLENT CHARGE AND AMMUNITION SHOT IN ACCORDANCE THEREWITH

CROSS REFERENCE TO RELATED APPLICATIONS

This application is a National Phase filing under 35 U.S.C. §371 of PCT/SE2009/000151 filed on Mar. 23, 2009; and this application claims priority to Application No. 0800729-6 filed in Sweden on Apr. 1, 2008 under 35 U.S.C. §119; the entire contents of all are hereby incorporated by reference.

TECHNICAL FIELD

The present invention relates to a method of, in the electrical ignition of a propellent charge provided with an electrically conductive surface coating and comprising one or more propellant components, ensuring that ignition and progressive combustion of the propellent charge take place.

The present invention also relates to a propellent charge, provided with an electrically conductive surface coating intended for electrical ignition, comprising one or more propellant components, at least one of which is multiperforated with burning channels.

In addition, the present invention relates to an ammunition shot intended to be utilized in accordance with the aforementioned method, as well as to an ammunition shot comprising a propellent charge according to the invention.

Problem Definition and Prior Art

The above mention of both propellent charges and propellant components is explained by the fact that the complete propellent charges can comprise a number of smaller propellant components in the form of more or less tightly packed geometric units, grains, rods, blocks, sheets, tubes, etc, which are arranged and/or packed together, preferably inside an ammunition case, one against the other, against the ammunition case and against other components possibly present in the loading space of the ammunition case and can also be multiperforated with burning channels, i.e. can comprise a greater number of mutually spaced perforations, cavities or holes, etc., which, from the outer side of the particular geometric unit, can pass wholly or partially through in order, via the burning channels, to increase the available free surface which can be ignited of said geometric unit and thus also for the particular, complete propellent charge. Said free surfaces are hence also hereinafter referred to as free burning surfaces. Propellant components and propellent charges of this type are usually made of some type of gunpowder, so that normally reference is often made to propellent gunpowder charges, propellent gunpowder components, granulated gunpowder, gunpowder blocks, propellent gunpowder sheets, etc. In this patent application, however, is meant all explosives which may be considered suitable for use according to the invention, even if just the term gunpowder were to be stated in the text to follow.

The mutual spacing between the aforementioned perforations, the so-called dividing distance, should here be tailored such that the propellant, and thus the propellent charge, which, when it is ignited, is intended to begin burning also along the inner burning surface of said burning channels, acquires a desired progressivity, i.e. combustion acceleration, and manages to burn itself out within the designed burning time. Since the propellant burns and is gasified not only from the outer side of the respective propellant component, but also inside the burning channels, whereby the burning channels are gradually widened with strongly increasing burning surface resulting therefrom, the total burning area will gradually be increased, which gives the propellant, or propellant component and the propellent charge, its overall progressivity. The dividing distance shall thus optimally correspond to double the desired burning length, in which the burning length is the section over which the propellant burns during the burning time, since the propellant will burn from two adjacent burning channels and one against the other. It is also conceivable that the perforation leaves a section equivalent to double the desired burning length unperforated, either in the middle of the propellant component, for example of the rod or of the particular corresponding geometric unit (thus after oppositely directed perforation from both directions), or along the opposite outer side thereof, in the case of perforation realized only from one side.

Multiperforated gunpowder in the form of larger blocks, sheets or, in certain cases, tubes, having perforations arranged at double the desired burning length apart and distributed evenly over the whole of its own surface, is not conceptually a new product. By way of example, reference can be made to U.S. Pat. No. 677,527 and British patent GB 16,861, both of which describe multiperforated propellent gunpowder, yet without giving any detailed information on how close together the particular perforations should lie or on suitable dimensions of the incorporated perforations. Quite simply, no such measurement specifications are included in these patent specifications, since, when the patents came into being in the 1890's, no suitable instruments were available which made it possible to measure how quickly the gunpowder actually burns. On the other hand, the author of the patents must be allowed to have had a certain view of the characteristics which he wished to extract from a propellent gunpowder charge via multiperforation. It is thus only in later times that it was realized how close together the perforations in a multiperforated propellant should actually lie and how a multiperforated propellant of this type can be produced, in a technically and economically acceptable manner, with sufficiently fine perforations. For more details on the production of multiperforated propellent gunpowder, reference is made to Swedish patent SE 518 867, from which it can be seen that a multiperforated modern propellent gunpowder, i.e. for the propellent charges and ammunition types which are normally used today, should have perforations having a diameter of about 0.1-1.0 mm and situated at a dividing distance from one another of about 1-6 mm.

It is previously known to fire propellent charges by means of an electrical igniter, the function of which can simply be described as an electrical heating of, expediently, a metal, which metal, through contact against a primer charge suitable for this purpose, ignites the primer charge by heating of the contact surface of the gunpowder against the incandescent metal to its ignition temperature at, for example, about 180-200° C., whereupon the gunpowder in the primer charge spontaneously ignites and, in turn, ignites a larger propellent charge which is disposed on and around the electrical igniter inserted inside the particular cartridge case. The fact that the igniter is disposed inside the ammunition case means that the total available loading space for the propellent charge naturally becomes smaller, and thus the maximum quantity of energy which can be utilized for the propulsion of a projectile is also reduced.

There is therefore a desire to find a method and a device in which a combustion-gas-driven barrel weapon can be fired by means of an electrical ignition, but in which the total available loading space of the ammunition case for the propellent charge is not reduced by an igniter inserted in the propellent charge. Moreover, the igniter per se entails a cost, since it is consumed for each fired ammunition shot. The notion of performing an electrical firing without the aid of an igniter peculiar to the ammunition shot is not, however, entirely new.

In U.S. Pat. No. 3,299,812, propellent charges intended for small-caliber weapons are described, consisting of metal-coated granulated multihole gunpowder which is initiated, i.e. ignited, electrically. According to this patent specification, from this metal-coated granulated gunpowder have also been produced larger coherent unit charges of more of less densely packed granulated gunpowder which has been surface-coated in the manner described in the patent specification, the surface-coated gunpowder grains being supplied with necessary ignition current via initiation points on the electrically conductive end face ends of the packaging which is utilized to hold together said unit charge. The electrical current supply is thus only for firing the propellent charge at certain, locally delimited initiation points by a, in relative terms, slow heating (0.1 to 0.25 seconds), from which initiation points a gradual, i.e. progressive, spreading of the combustion is then intended to take place without further external energy influence or energy supply.

One of the problems which the invention described in said document sets out to solve is how a sufficiently homogeneous ignition of a gunpowder charge for the production of an explosive, i.e. a gradually accelerating, combustion of the same shall be able to be realized with only a minimum of supplied electrical energy. In a trial described in greater detail in the document, the above described propellent charges consisting of metal-coated granulated multihole gunpowder are initiated by virtue of a weak electric current of less than 7 Amperes and only 1.2 Volts from two parallel-connected standard nickel-cadmium batteries of 4 Amperes and 1.25 Volts apiece being passed through the surface coating of the gunpowder grains for about 0.1 to 0.25 seconds and thereby heating the gunpowder grains adjacent to the surface coating to a temperature which leads to the spontaneous ignition of the gunpowder and its gradual spreading through the propellent charge.

The quantity of electrical energy which is required for the ignition is given at as low as 5 Watt seconds per half the quantity of gunpowder which is present in a .22 caliber rifle cartridge. All the examples included in this patent specification thus purely concern an electrical initiation via heating, by means of a minimum possible weak-current supply, of smaller compact propellent charges, whose basic component is a granulated metal-coated multihole gunpowder. In said document U.S. Pat. No. 3,299,812, it is also stated that silver Ag, nickel Ni, zinc Zn, aluminum Al, copper Cu, iron Fe, cobalt Co, molybdenum Mo, platinum Pt and gold Au can be utilized to give granulated gunpowder an electrically conductive surface coating.

As previously indicated above, the propellent charges can be packed together and/or arranged close together in a variety of fits and volumes, by means of smaller geometric units of multiperforated propellant, and can thereby be given high load weights, which are difficult or very often impossible to achieve in any other way in ammunition. In addition to the previously stated shapes of the geometric units, it is also possible to cite propellant disks stacked one on top of the other inside the ammunition case and having a diameter and thickness which varies according to the inner side of the case, possibly also provided with holes for parts inserted into the propellent charge, for example the rear end of the projectile, etc., thereby enabling the case to be loaded in a faster, simpler and more effective manner. A more compact and thus larger propellent charge for each given loading space, i.e. with higher propellent charge density, gives a larger available energy quantity, which, for example in a barrel weapon, can be used to attain a higher initial velocity ($V_0$), i.e. its muzzle velocity ($V_0$) out of the barrel muzzle, for a projectile. A higher initial velocity ($V_0$) can be utilized to, for example, increase the range, improve the penetrability, reduce the period of flight of the projectile, etc. Great efforts have therefore been made and continue to be made to obtain a higher and higher muzzle velocity ($V_0$) for such projectiles. The possible increase in velocity in respect of a certain given loading space is, however, limited. This is due to the fact that the extra quantity of propellent charge which is introduced into the loading space through tighter packing, and the additional propellent gases which are formed therefrom during the combustion, must also themselves be accelerated through the barrel, see in greater detail below.

With more compact propellent charges, moreover, the problem ensues of how an instantaneous, i.e. momentary, and full flashover ignition of the propellant along all of its burning surfaces intended for flashover ignition shall be able to be achieved. Already in charges of conventionally granulated gunpowder, it is a well known fact that the flashover ignition between the gunpowder grains often occurs in a slightly random and sporadic manner, so that an intermittent and, in crossing directions, irregular spreading of the flashover ignition occurs via one or more initiation points, which produces an uneven pressure wave through the propellent charge. This pressure wave, which is created by the burning gunpowder, can also cross the gunpowder grains, so that they burn locally more rapidly and then give rise to a resonance pressure wave, a so-called pendulum pressure, which can increase the amplitude of the pressure wave to the point where the permitted maximum pressure of the barrel is exceeded so that the barrel bursts.

The basic principle behind the present invention is therefore that the flashover ignition of all the propellant incorporated in the propellent charge shall be able to be effected instantaneously, at the same time, over all the burning surfaces available for ignition. An instantaneous flashover ignition gives immediately from the moment of ignition the maximum possible energy quantity, i.e. with respect to the particular composition, configuration and arranged burning area, from the propellent charge used in the firing and thus also the maximum initial generation of propellent gas for the propulsion of the projectile, at the same time as the pressure wave is very homogeneous and uniformly progressive through the propellent charge, since all incorporated propellant components and the burning surfaces of all the propellant components are ignited simultaneously. The burning characteristics of the propellant can therefore be calculated more precisely in the dimensioning of the propellent charge, since a full combustion of the propellant can now be assumed and the previous random ignition between the propellant components has been eliminated.

However, the capacity of the propellent charge to generate propellent gas must be kept at a lower level at the start of the ballistic sequence in order, as stated above, to prevent the maximally permitted pressure for the barrel from becoming too large, while the quantity of generated propellent gas per unit of time must thereafter strongly increase right up to the end of the sequence to compensate for the constantly increasing volume inside the barrel behind the accelerating projectile. At present, this is normally achieved through the use of ammunition containing a progressive propellant, for example comprising the aforementioned multiperforated propellant components, which burn faster toward the end of the combustion process. The aforementioned combustion-gas-driven, progressive ammunition too, however, has a practically possible upper limit for the acceleration of the muzzle velocity, at about 1800 m/s.

A number of different propulsion principles are currently under development for the attainment of said desired higher initial velocity for various sorts of projectiles, of which propulsion by means of electrical drive is interesting in respect of the present invention.

Purpose and Characterizing Features of the Invention

One object of the present invention is thus to provide a new method, a new propellent charge and a new ammunition shot comprising the propellent charge, in order to ensure, in the electrical ignition of the propellent charge, an instantaneous flashover ignition of said propellent charge, and then especially in propellent charges comprising various configurations of multiperforated geometric units of smaller propellant components.

A second object of the present invention is to provide a new method, a new propellent charge and a new ammunition shot comprising the propellent charge in order to obtain, in the electrical ignition of the propellent charge, a more accurately dimensioned and considerably fuller progressive combustion of said propellent charge and thus a better predetermined energy development, for example for the propulsion of a substantially combustion-gas-driven projectile through a barrel.

Another object of the present invention is to provide a new method, a new propellent charge and a new ammunition shot comprising the propellent charge in order to electrically ignite the propellent charge without the aid of a conventional percussion primer or ignition generator inserted in the propellent charge, whereby a larger loading volume and fewer necessary components are obtained.

It is also an object to provide a new method, a new propellent charge and a new ammunition shot comprising the propellent charge, in order, in addition to the conventional chemical energy development from a given propellent charge, to further be able to influence and, at the same time also to control, a total energy supply for the ignition and propulsion of an earlier substantially combustion-gas-driven projectile through a barrel, and then preferably for a substantially greater part of the combustion process of the propellent charge and, ideally, throughout the acceleration process of the projectile through each particular barrel, which method, propellent charge and ammunition shot should also give a considerably higher initial velocity for the projectile compared with currently known propellant-gas-driven barrel weapons, i.e. a desired velocity at the outlet of the barrel of over 2000 m/s, and this assuming an unchanged projectile weight and case volume for the particular ammunition.

A further object of the present invention is to provide a new method, a new propellent charge and a new ammunition shot comprising the propellent charge in order to benefit, in the electrical ignition of the propellent charge, from advantages from a number of different propulsion principles to achieve a higher initial velocity for different projectiles, with use being made of propulsion by means of chemical energy, together with electrical drive for driving of the projectile. By chemical energy is here meant the energy stored in chemical bonds between atoms and molecules, while by electrical drive we mean that additional energy is supplied electrically to the propulsion.

Said objects, as well as other aims which are not listed here, are satisfactorily met within the scope of that which is stated in the present independent patent claims. Embodiments of the invention are set out in the dependent patent claims.

Thus, according to the present invention, a method has been produced of ensuring that ignition and progressive combustion of the propellent charge take place in the electrical ignition of a propellent charge provided with an electrically conductive surface coating and comprising one or more propellant components, which method is characterized in that said electrically conductive surface coating, when ignition of the propellent charge is desired, is connected to an electrical high-voltage source, in that said high-voltage source is made to generate at least one high electrical pulse to said connected electrically conductive surface coating, and in that said at least one high electrical pulse produces an instantaneous flashover ignition of the electrically conductive surface coating of the propellent charge and of all its propellant components simultaneously.

According to further aspects of the method according to the invention:

- the propellant components of the propellent charge, in the form of smaller geometric units, are arranged and/or packed together into a desired propellent charge configuration, which propellant components have preferably been multiperforated with burning channels;
- at least the majority of the free outer burning surfaces of the propellent charge, and inner burning surfaces of the burning channels emanating therefrom, are provided with said electrically conductive surface coating prior to the ignition;
- at least the majority of the free outer burning surfaces of the propellant components incorporated in the propellent charge, and inner burning surfaces of the burning channels emanating therefrom, are provided with said electrically conductive surface coating prior to the make-up into the particular propellent charge and prior to the ignition;
- the at least one high electrical pulse is so rich in energy that said electrically conductive surface coating is converted into an ionized plasma;
- the electrical high-voltage source, which comprises a regulatable pulse unit, is made to deliver a plurality of additional high electrical pulses one after the other, and in that the additional high electrical pulses are supplied to the formed plasma, so that also the combustion gases which are formed by the chemical combustion of the propellent charge are ionized, whereby a controllable energy level and total energy development suppliable with additional electrical energy are achieved;
- the energy from said progressive combustion and the at least one supplied high electrical pulse or pulses are utilized for the propulsion of at least one projectile through a barrel;
- additional electrical energy, which is regulatable in terms of energy, in addition to the chemical energy from the combustion of the propellent charge, is supplied to the propulsion via the additional electrical pulses to the ionized plasma, whereby it becomes possible to monitor and control the propulsion of the projectile during the whole or parts of the acceleration through the barrel;
- following a discharged ammunition shot, the total pressure in the barrel distributed over time is regulated by means of additional energy pulses which each create new pressure pulses, the pressure variance of which over time is made to mutually overlap in such a way that the total barrel pressure distributed over time is optimized according to a desired pressure development that always falls short of the highest permitted maximum pressure of the barrel.

the supplied high electrical pulse or pulses is/are given a voltage strength of about 1,000 Volts to about 50,000 Volts, preferably about 7,000 Volts;

the supplied high electrical pulse or pulses is/are given a current strength of about 3,000-20,000 Amperes;

the electrically conductive surface coating is applied to the whole or parts of the burning surfaces of the propellent charge with any one of the methods: galvanization, plating, chemical steam deposition, sputtering, dipping or painting with electrically conductive paint;

the electrically conductive surface coating is applied to the whole or parts of the burning surfaces of the propellent charge as a glue, preferably an epoxy-based conductive copper coating;

when the ambient temperature is disadvantageous, this disadvantageous temperature is compensated by adaptation of the supplied electrical energy in accordance therewith.

The propellent charge, according to the present invention, is characterized in that at least the majority of all the free outer burning surfaces of the propellant components incorporated in the propellent charge, as well as the inner burning surfaces of all burning channels originating therefrom, comprise said electrically conductive surface coating.

According to further aspects of the propellent charge according to the invention:

it comprises a plurality of smaller propellant components in the form of smaller geometric units which are arranged and/or packed together in the propellent charge and which are made up into a certain set volume, preferably matched to the loading space of a particular ammunition case;

the electrically conductive surface coating is comprised of an applied individual material layer, a coating or a composite of a plurality of different materials, in which at least one is electrically conductive, which electrically conductive surface coating is preferably made of or comprising one or more metals or semiconductors;

the electrically conductive surface coating comprises one or some of the metals silver Ag, nickel Ni, zinc Zn, aluminum Al, copper Cu, iron Fe, cobalt Co, molybdenum Mo, platinum Pt, gold Au or titanium Ti, and/or one or some of the semiconductors graphite C, germanium Ge or gallium arsenide GaAs.

The ammunition shot according to the invention is characterized in that ignition and combustion of the propellent charge are ensured according to any one of the specified method requirements, and in that the ammunition shot comprises a propellent charge free from percussion primer and ignition generator, as is defined in the claims.

According to further aspects of the ammunition according to the invention:

the ammunition shot further comprises an electrically conductive ammunition case, which ammunition case is coated with at least one electrical insulation over substantially the whole of the inner side of the ammunition case, an input conductor and an output conductor connected to a high-voltage source, preferably comprising a pulse unit, and a front projectile part disposed on the ammunition case;

the ammunition shot further comprises a front uninsulated region of the ammunition case for producing a first electrical contact between the electrically conductive surface coating on the propellent charge and the metallic ammunition case, and to which ammunition case the output conductor is connected, as well as an insulating case through the back piece of the ammunition case, by which insulating case the input conductor is connected to produce a second electrical contact to the electrically conductive ignition coating of the propellent charge for the formation of a closed electric circuit between the ammunition shot and the high-voltage source;

the ammunition case is constituted by an electrically non-conductive ammunition case having a front electrically conductive first contact through the electrically non-conductive ammunition case into the electrically conductive ignition coating connected to the output conductor and a rear electrically conductive second contact through the electrically non-conductive ammunition case into the electrically conductive ignition coating connected to the input conductor, which input and output conductors are connected to the high-voltage source.

Advantages and Effects of the Invention

The primary concept behind the present invention is now that the ignition of the particular multiperforated propellant shall be carried out electrically via the thin electrically conductive surface coating, hereinafter referred to, therefore, as the ignition coating, without any form of separate igniter, such as percussion primer or ignition generator, inserted inside the propellant or the ammunition. Since the thin surface coating is in itself electrically conductive, it only needs to be connected to a respective input and output line of the electrical high-voltage source in order for ignition and plasma formation to be realized, so that, where a metal ammunition case is used, the ammunition case is expediently disposed against an external electrical contact on the bottom of the case and another on its neck, whereby an electric circuit is obtained. Where an electrically insulated case is used, either coated with or made of electrically insulating material, two electrical transmission points are instead arranged through the case insulation to said electrically conductive surface coating. As a result, the loading space is gained which would otherwise have to be utilized for the igniter. This loading space which is hence released can thus be utilized to increase the load weight for the ammunition and thus the effect of the charge and of the ammunition. At the same time, the very use of geometric units of multiperforated propellant components in the charge already implies possibilities of making up compact propellent charges with very high load weights and thus with very high energy content, at the same time as the electrical ignition principle according to the present invention implies a possibility for the momentary flashover ignition of all propellant components incorporated in the particular propellent charge, both along their outer sides and inside the burning channels of all these components, by virtue of the fact that the burning surfaces thereof are provided with electrically conductive ignition coatings. Taken together, all this provides a very good progressivity with wholly predetermined energy development and exact burning time for propellent charges of this type, at the same time as the risk of emergence of the pendulum pressures which are so dreaded in an artillery context has been able to be wholly eliminated.

Another advantage of the electrical ignition principle according to the invention is that this is very well suited to the initiation of propellent charges in so-called telescopic ammunition, i.e. such ammunition in which the projectile itself is disposed far into the space which is otherwise primarily taken up by the propellent charge and in which, therefore, parts of the propellent charge surround the rear part of the projectile.

An often occurring problem with such ammunition has namely previously been that the flashover ignition of the propellent charge easily became uneven, in that the rear part of the projectile screened off parts of the propellent charge in the flashover ignition and during the continued combustion process, resulting in the emergence of the aforementioned pendulum pressure.

The electrical ignition principle according to the invention in a more refined form states that each propellant component in its entirety is coated with a surface-covering ignition coating, or that at least the majority of all the free outer burning surfaces of propellant components incorporated in the propellent charge, as well as the inner burning surfaces of all burning channels originating therefrom, are provided prior to the ignition with an electrically conductive surface coating, which, upon the desired initiation of the propellant, is connected to a high-voltage source, whereupon said ignition coating is converted into an electrically conductive plasma, see further clarification below, which instantaneously ignites the propellant over all the burning surfaces provided with said surface coating, i.e. that a surface-coating plasma is produced. In multiperforated propellants, it is thus an advantage if the electrically conductive surface coating (the ignition coating) also extends down into all perforations and other holes, etc. which have been arranged with the aim of constituting burning channels or burning surfaces, since an instantaneous flashover ignition of the propellant is then obtained even inside and along these spaces and surfaces. It can also be imagined that a propellent charge is first made up out of preferably multiperforated, variously shaped propellant components into a certain propellent charge configuration, for example according to the internal dimension of a particular ammunition case, and is then provided with the electrically conductive ignition coating over its free surfaces and down into the inner surfaces of the burning channels, so that the non-free surfaces placed one against the other thus remain deprived.

Note that the ignition according to the invention is thus not realized via a slow gradual weak-current heating of a locally situated initiation point until a chemical spontaneous ignition temperature is attained, but rather via a momentary "physical plasmafication", i.e. a vaporization and ionization of the evaporation gases which have been formed by the electrically conductive surface coating universally at once with the aid of very high electrical energy supplied from the high-voltage source.

Through utilization of the extremely hot, electrically conductive and, in terms of energy, controllable plasma generated via the high-voltage source and the ignition coating, according to the present invention the sought-after instantaneous and full flashover ignition of all the burning surfaces prepared for flashover ignition is now achieved in even the most compact of all propellent charges with the greatest load weights and the highest propellent charge density which can currently in any way be made up of various configurations of layers, arranged closely together, of shaped geometric units of multiperforated propellant components and types of explosive.

A further and appreciable advantage with the present invention is thus that it becomes possible to monitor and control the propulsion of the projectile during the whole or parts of the acceleration through the barrel, since additional, in terms of energy, regulatable electrical energy, in addition to the chemical energy from the combustion of the propellent charge, can be supplied to the propulsion via the ionized plasma.

Also the fact that in the present invention the electrically conductive surface coating replaces the impact-sensitive and tear-sensitive primer cap of the conventional mechanical percussion primer offers the advantage that the ammunition can no longer be accidentally triggered by a minor shock or shaking, for example by being dropped during handling or transport.

LIST OF FIGURES

Figure 2:
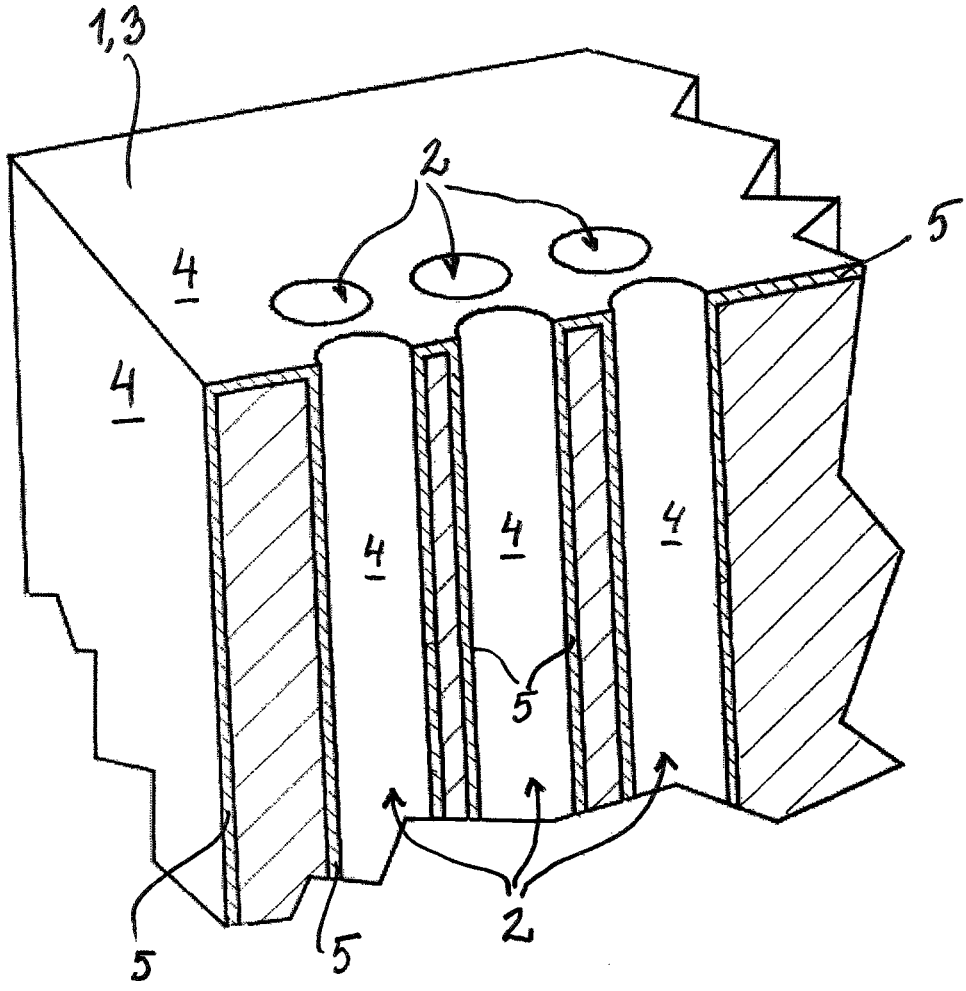
Figure 3:
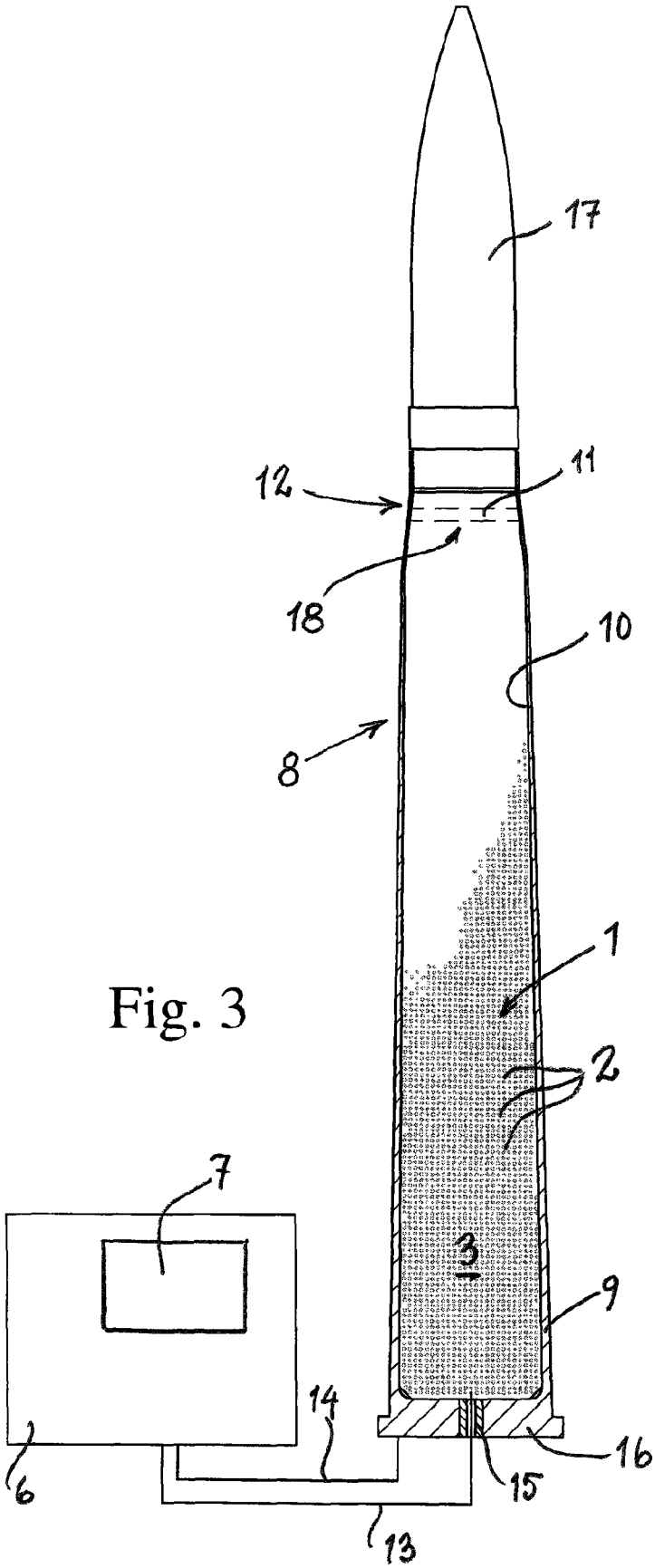

The invention will be described in greater detail below with reference to the appended figures, in which:

FIG. 1, according to the invention, schematically shows a multiperforated propellant component in the form of a propellant block comprising an applied electrically conductive surface coating and which propellant component has been connected to a high-voltage source comprising a pulse unit, FIG. 2 schematically shows a corner portion of the propellant component according to FIG. 1 in cross-sectional perspective, i.e. a top surface and a side surface, and a cross-sectional area having three rows of burning channels with inner burning surfaces, which surfaces and channels comprise surface coatings of electrically conductive material which are arranged thereon or therein, FIG. 3 schematically shows a cross section of an ammunition shot configured in accordance with one embodiment of the present invention, which ammunition shot is connected to a schematically shown high-voltage source via an input conductor and an output conductor.

DETAILED DESCRIPTION OF EMBODIMENTS OF THE INVENTION

FIG. 1 shows an embodiment of a multiperforated propellant component 3 incorporated in a propellent charge 1 and multiperforated by means of burning channels 2, here especially in the form of a rectangular propellant block, which, according to the invention, via a covering, electrically conductive surface coating 5 applied over certain or all free burning surfaces 4 existing for ignition, see FIG. 2, (also hereinafter referred to as the ignition coating), has been prepared for an instantaneous electrical flashover ignition, and which propellant component 3, together with other propellant components existing in the particular propellent charge 1, has been connected to a high-voltage source 6 (shown schematically) comprising a pulse unit 7 for the production of a pulsed plasma, which plasma realizes the desired instantaneous flashover ignition (hereinafter referred to as plasma ignition), a controllable progressive combustion of the particular propellent charge 1, as well as a, in terms of energy, regulatable energy supply to the combustion process, preferably for the realization of a much more effective propulsion and at a significantly higher muzzle velocity ($V_o$) of a projectile along a barrel (not shown in detail).

In FIG. 2, a corner portion of the propellant component 3 according to FIG. 1 is shown schematically in cross-sectional perspective, i.e. here a multihole gunpowder having two outer free burning surfaces 4, consisting of a top surface and a side surface, and a cross-sectional surface having three rows of burning channels 2 with inner burning surfaces 4, which outer and inner burning surfaces 4 comprise surface coatings 5 of electrically conductive material which are arranged thereon.

FIG. 3 shows in schematic representation a cross-section of an ammunition shot 8 configured in accordance with one embodiment of the present invention, containing a propellent charge 1 which is free from percussion primer and from ignition generator and is multiperforated with burning channels 2. The ammunition shot 8, according to the shown embodiment, comprises an electrically conductive, expediently metallic, ammunition case 9, which ammunition case 9 is lined with at least one internal electrical insulation 10, which electrical insulation 10 extends over substantially the whole of the inner side of the ammunition case 9 (and outer side in the case also of an external electrical insulation), except in a smaller uninsulated region 11 close to the neck opening 12 of the ammunition case 9, for the realization of an electrical contact between the electrically conductive surface coating 5 on the propellent charge 1 and the metallic ammunition case 9. The ammunition shot 8 and the propellent charge 1 are further connected, via an input conductor 13 and an output conductor 14, to the high-voltage source 6 (shown schematically), preferably also comprising the aforementioned pulse unit 7. In order to avoid a short-circuit, the shown ammunition case 9 is arranged with an insulating case 15 through the back piece 16 of the ammunition case 9, by which insulating case 15 the input conductor 13 is connected to the electrically conductive ignition coating 5 of the propellent charge 1. The ammunition shot 8 also has a front projectile 17, which is fitted in the neck opening 12 of the ammunition case 9 and which projectile 17 bears against the front end 18 of the propellent charge 1.

In another embodiment (not shown), the ammunition case can be constituted by an electrically non-conductive ammunition case, for example made of plastic or fiberglass, whereupon the aforementioned insulating case 15 (shown in FIG. 3) through the back piece 16 of the ammunition case 9 becomes superfluous, while the small uninsulated region 11 close to the above-situated neck opening 12 of the ammunition case 9 is replaced by an electrically conductive contact point or contact region (not shown) through the electrically non-conductive ammunition case into the electrically conductive ignition coating. It is then also necessary for an electrical connection to be arranged along the longitudinal side of the case in order to produce a closed electric circuit to allow the ammunition shot to be fired. It is also conceivable for the barrel of the particular weapon to be utilized or especially equipped to form a closed electric circuit for the electric current, in which case special regard should be given to ensuring the electrical safety for staff and equipment as a consequence of the barrel having been made live.

By plasma ignition and pulsed plasma is meant in the present invention that said surface coating 5 of electrically conductive material, coating or composite of a plurality of different materials, preferably made of or comprising one or more metals or semiconductors, via one or more very high electrical pulses, is instantaneously vaporized and ionized into the so-called plasma, i.e. into an aggregation state in which the electrons have been separated from the atomic nuclei and have in themselves become electrically conductive, which plasma, during the whole or parts of the combustion and/or acceleration process, via new electrical pulses, can either be substantially maintained at a set energy level or gradually changed to a desired energy level which preferably implies an increase to an energy level which is significantly higher than the natural chemical energy level of the propellant. The extremely high temperature (about 10,000° C.) of the plasma, to compare with the ignition temperature of a herein exemplified gunpowder of about 180-200° C. and combustion temperature of around 1,000° C., influences the combustion of the propellent charge 1 in a number of positive aspects, which aspects together can be utilized, for example, to obtain said desired higher muzzle velocity for the projectile or projectiles of the particular ammunition.

For example, it is possible via the plasma to make the propellent charge 1 burn faster toward the end of the combustion process, i.e. substantially improve the progressivity of the propellent charge. Hence a greater quantity of propellent charge 1 is burnt before the projectile leaves the barrel, so that the quantity of propellent charge 1 can be increased for each given ammunition case. Moreover, more energy is obtained from the same quantity of propellent charge, by virtue of a fuller combustion. More modern propellent charges and newly developed, better propellant types, which are not normally used in connection with propellent charges or which cannot be ignited with conventional percussion primers, such as propellant with high energy content and low molecular weight for the propellent gases including multiperforated propellant and certain chemically surface-treated propellant types, can now be utilized through the use of the plasma ignition according to the present invention. If the ambient temperature or the temperature of the propellent gases is disadvantageous, it is also possible to compensate for this in a much simpler way, since the quantity of supplied electrical energy can be varied, i.e. increased or reduced. The total pressure curve, i.e. the total pressure in the barrel caused by the combustion of the propellent charge and the additionally supplied electrical energy distributed over time, which is obtained for the particular barrel when a shot has been discharged, can thus be tailored such that said pressure curve does not exceed the permitted maximum pressure of the barrel and such that the pressure in the barrel distributed over time (the pressure variance) is either optimized according to a desired pressure development or is always as optimal as possible, i.e. the individual pressure curves for each pressure pulse caused by a respective electrical energy pulse mutually overlap in such a way that the pressure troughs of the total pressure curve are minimized.

Problems with uneven ignition of the propellent charge 1, and the propellant components 3 existing in the propellent charge 1, are eliminated, since the plasma ignition of the propellent charge 1 takes place simultaneously over all burning surfaces 4 accessible by the plasma. This is especially advantageous in the ignition of granulated propellant or in perforated 2 propellent charges 1, in which a conventional ignition, which always occurs at and from an initiation point determined by the igniter, and not simultaneously over the whole of the voltage-exposed surface coating 5, as is the case in the present invention, only produces a running ignition which is spread from contact surface to contact surface, so that varying grain sizes, degrees of packaging, number and direction of perforations, etc. acquire a much greater influence on the combustion process than in the case of the plasma, which spreads more easily and more rapidly and which, via current/voltage pulses, influences the process everywhere at once. The current/voltage pulse(s) delivered from the pulse unit 7 of the high-voltage source 6 namely follow the path through the formed plasma, which plasma has a very high conductivity due to the ionization of the molecules which are formed in the gasification of the ignition coating 5 and which ionization is replenished with ions from a further ionization of the combustion gases of the propellant, so that each new pulse directly, i.e. instantaneously influences, on the one hand, each existing burning surface 4 of the propellent charge 1 and, on the other hand, the formed propellent gases which are reached by the plasma. The ability of the electrically conductive ignition coating 5 to be applied also inside the burning channels 2 means that the instantaneous plasma formation, and the contingent other advantages described in this text, are achieved here too.

For example, by sending a plurality of current/voltage pulses with a certain set strength and energy content, duration, variance and interval one after the other through the plasma, it is possible to control the plasma, and thus the pressure in the barrel from the formed propellent gases can be substantially monitored and/or maintained for a substantially longer period at a level desired for the particular barrel. Thus, a progressive acceleration of the projectile 17 for a longer part of the firing process is obtained, at the same time as the maximum compressive strength of the barrel is never exceeded.

Functional Description

Upon firing of an ammunition shot 8 situated in the chamber position of a weapon system prepared for electrical firing, a high-voltage source 6 is connected to the electrically conductive ignition coating 5 of the propellent charge 1. The high-voltage source 6, for example a pulse unit 7 (Pulse Power Supply, PPS), is made to deliver at least one strong pulse, though preferably a plurality of pulses, comprising a high current strength and/or a high voltage. Where a pulse unit is used, this comprises capacitors for delivering voltage of about 1,000-50,000 Volts. The current strength used amounted to about 7,000 Amperes. The pulse time can be as low as 0.001 seconds, i.e. up to 250 times faster than in the aforementioned example involving heating for spontaneous ignition, in which, moreover, a minimum of supplied energy (7 Amperes at 1.2 Volts) was sought. Other known PPS units comprising thyristor converters can generate pulses of about 4,000 Volts combined with a current strength of up to 20,000 Amperes.

The strong pulse or pulses, for example about 1-4 pulses, instantaneously heat the electrical ignition coating 5 over 100% of its surface to such a high temperature that it is gasified and ionized into the very hot plasma. The heat from this plasma then, in turn, gasifies the propellent charge 1 into the propellent gases which push out the projectile 17 through the barrel of the weapon, and which propellent gases, too, are ionized by the following pulses. The performance of such Electro-Thermal-Chemical (ETC) weapons is influenced not only by the total supplied energy, but also by the length of the pulses and where the plasma is allowed to act.

The interval between the pulses can, of course, be varied according to prevailing conditions at the moment of firing and according to specific characteristics of the present weapon system, so that an improved flashover ignition of and effect from the propellent charge 1 is obtained. This is realized by the advantageous characteristics of the particular plasma being substantially maintained between the pulses, since the plasma does not have time to die down or fade to a level which is unfavourable for the ignition and combustion of the propellent charge 1. Moreover, the separate pulses can be made to act upon the electrical ignition coating 5 and the propellent charge 1 step by step. For example, the first pulse can produce an electrical ignition and an ionization of the electrical ignition coating 5, and the following pulses can, in turn, generate an energy variance in the formed plasma for controlling the combustion process of the propellent charge 1 and the total pressure in the barrel during the whole of the propulsion of the projectile part 17 through the barrel.

Since the propellent charge 1 is burnt much more effectively by the pulsed plasma, a pressure maximum will be obtained which is higher for the same propellent charge 1 than in a comparable conventional ignition, at the same time as one or more further pressure increases can be obtained, which can be made to mutually overlap such that the pressure troughs of the total pressure curve are minimized, whereby the total pressure curve, throughout the period for which the projectile is in the barrel, is kept as close as possible to the maximum pressure permitted for the particular barrel. Thus the optimal acceleration of the present projectile is achieved for each particular barrel, and hence also the maximum muzzle velocity and range for the particular weapon.

Alternative Embodiments

The invention is not limited to the shown embodiment, but can be variously modified within the scope of the patent claims. For example, an instantaneous flashover ignition and a controlled progressive combustion of an explosive charge 1 can also be applicable in other applications than in barrel weapons.

It will also be appreciated that, in addition to different types of gunpowder, suitable alternative explosives may also be considered. It will further be appreciated that said propellent charge 1, which expediently has been shaped to fit inside and against the inner side of the used type of ammunition case, can obviously consist of just a singular propellent component 3, but which propellent charge 1 normally comprises a plurality of smaller propellant components 3 in the form of geometric units which are arranged more or less closely together and/or are packed together and which, depending on mutual placement in the composed propellent charge configuration 1, are expediently given such outer surfaces that each individual geometric unit precisely fits to the inner side of the surrounding ammunition case 9, any projectile part 17 inserted in the propellent charge 1, and all other directly adjoining other geometric units. It is also conceivable to compose a propellent charge 1 from many different sorts of propellant components 3, for example with respect to combustion speed, combustion temperature, chemical composition, conductive ignition coating or not, etc., which various propellant components 3 are then arranged axially and radially in the propellent charge 1 according to their mutual characteristics.

The above-specified geometric units can have many different lengths and volumes, such as grains, rods, blocks, disks, sheets, tubes, bars, etc., and combinations thereof in different shapes and cross sections, such as polygonal (triangular, rectangular, square, etc.) and rounded (oval, crescent-shaped, cylindrical, etc.) or in the shape of curved or rolled sheets. The geometric units are normally also multiperforated with burning channels 2, i.e. comprise a considerable number of perforations, cavities or holes, etc. arranged at a predetermined distance apart, which, from the outer side of the outer surface of the particular geometric unit, can pass wholly or partially through in order, via the burning channels 2, to increase the available free burning surface 4 of said geometric unit.

The described perforations 2 constitute just a few exemplifications among many. The perforation pattern can, of course, be varied according to the burning lengths, the progressivity and other characteristics which are desired for the particular propellent charge 1.

The invention per se is not directly dependent on which electrically conductive material(s) is/are incorporated in the surface coating or the coating 5 or how the latter explicitly has been realized, and, as can be seen from above, there are a number of different electrically conductive metals, which have long been known and can be applied with different known methods to, for example, a gunpowder, in order to give this a suitable electrically conductive surface coating 5. We can here add, however, that the ignition coating 5, in addition to what has already been listed, can also advantageously comprise titanium Ti, graphite C and other semiconductors. Although a semiconductor, for example germanium Ge or gallium arsenide GaAs, does not conduct electricity as well as a conductor, nor does it exclude current conduction. An extra advantage with the electrically conductive ignition coating 5 according to the invention is that this coating, as an extra bonus, lends each propellant component 3 an effective moisture protection.

As examples of some methods for providing the propellant in question with a suitable conductive surface coating 5 can be cited galvanization, plating, chemical steam deposition (vacuum steaming), sputtering, dipping or painting with electrically conductive paint. It is also proposed that a conductive coating of electrically conductive material 5 is applied by means of glue, for example an epoxy based conductive copper coating, which also lends a certain flexibility.

The applied electrically conductive surface coating 5 should be configured with respect to thickness and covering and should be of such a composition that the surface coating 5 acquires an electrical conductivity, suitable for the invention, over all custom-made burning surfaces 4 and burning channels 2, at the same time as a momentary vaporization and ionization of the surface coating 5 is realized in the ignition of the propellent charge 1. From this follows that the optimal surface coating 5 in the great majority of cases will have a thickness of around one to a few thousandths of a millimetre, and that the surface coating 5 is disposed not only on the free outer surfaces 4 of each propellant component 3, but also down into and on the inner burning surfaces 4 of all the burning channels 2.

According to a preferred embodiment of the invention described in greater detail below, the propellant components 3 incorporated in the respective propellent charge 1 are comprised of intrinsically specific products comprising multiperforated 2 propellant blocks, propellant sheets, propellant tubes, etc., which already, individually, are prepared for electrical ignition and progressive combustion, which propellant components 3 can thus be combined into various types of propellent charges 1, whose characteristics are determined according to ammunition and weapon type, cartridge dimension, projectile type and desired effect for the projectile type, and then specifically for such propellent charges of which absolutely optimal characteristics, such as maximum muzzle velocity and range in, in particular, combat vehicle guns and extremely long-range artillery ordnance, are demanded.

Method for Electrical Flashover Ignition and Combustion of Propellent Charge, as Well as Propellent Charge and Ammunition Shot in Accordance Therewith 1. propellent charge/propellent charge quantity
2. burning channels, multiperforated
3. propellant component, propellant block
4. burning surfaces
5. electrically conductive surface coating/ignition coating
6. high-voltage source
7. pulse unit
8. ammunition shot
9. cartridge case
10. electrical insulation
11. smaller uninsulated region
12. neck opening, cartridge case
13. input conductor
14. output conductor
15. insulation sleeve
16. back piece
17. projectile/projectile part
18. front end, propellent charge

The invention claimed is:

1. A method for electrical ignition of a propellant charge provided with an electrically conductive surface coating and comprising one or more propellant components, ensuring that ignition and progressive combustion of the propellant charge takes place, wherein said propellant charge has free burning channels and at least a majority of free outer burning surfaces of the propellant charge, and inner burning surfaces of burning channels emanating therefrom, are provided with said electrically conductive surface coating prior to the ignition and wherein said method comprises:

connecting said electrically conductive surface coating, when ignition of the propellant charge is desired, to an electrical high-voltage source, wherein said high-voltage source generates at least one high electrical pulse to said connected electrically conductive surface coating, and wherein said at least one high electrical pulse produces an instantaneous flashover ignition of the electrically conductive surface coating of the propellant charge and of all its propellant components simultaneously.

2. The method as claimed in claim 1, wherein the propellant components of the propellant charge, in the form of smaller geometric units, are arranged and/or packed together into a desired propellant charge configuration, which propellant components have been multiperforated with burning channels.

3. The method as claimed in claim 2, wherein the propellant components have been multiperforated with burning channels.

4. The method as claimed in claim 1, wherein at least the majority of the free outer burning surfaces of the propellant components incorporated in the propellant charge, and inner burning surfaces of the burning channels emanating therefrom, are provided with said electrically conductive surface coating prior to the make-up into the particular propellant charge and prior to the ignition.

5. The method as claimed in claim 1, wherein the at least one high electrical pulse is so rich in energy that said electrically conductive surface coating is converted. into an ionized plasma.

6. The method as claimed in claim 5, wherein the electrical high-voltage source, which comprises a regulatable pulse unit, is made to deliver a plurality of additional high electrical pulses one after the other, and in that the additional high electrical pulses are supplied to the ionized plasma, so that also the combustion gases which are formed by the chemical combustion of the propellant charge are ionized, whereby a controllable energy level and total energy development suppliable with additional electrical energy are achieved.

7. The method as claimed in claim 1, wherein the energy from said progressive combustion and the at least one supplied high electrical pulse or pulses are utilized for the propulsion of at least one projectile through a barrel.

8. The method as claimed in claim 7, wherein, fo11owing a discharged ammunition shot comprising the projectile, the total pressure in the barrel distributed over time is regulated by means of additional energy pulses which each create new pressure pulses, the pressure variance of which over time is made to mutually overlap in such a way that the total barrel pressure distributed over time is optimized according to a desired pressure development that always falls short of the highest permitted maximum pressure of the barrel.

9. The method as claimed in claim 1, wherein additional electrical energy, which is regulatable in terms of energy, in addition to the chemical energy from the combustion of the propellant charge is supplied to the propulsion via the additional electrical pulses to the ionized plasma, whereby it becomes possible to monitor and control the propulsion of a projectile during the whole or parts of the acceleration through a barrel.

10. The method as claimed in claim 1, wherein the supplied high electrical pulse or pulses is/are given a voltage strength of about 1,000 Volts to about 50,000 Volts, preferably about 7,000 Volts.

11. The method as claimed in claim 1, wherein the supplied high electrical pulse or pulses is/are given a current strength of about 3,000-20,000 Amperes.

12. The method as claimed in claim 1, wherein the electrically conductive surface coating is applied to the whole or parts of the burning surfaces of the propellant charge with any one of the methods: galvanization, plating, chemical steam deposition, sputtering, dipping or painting with electrically conductive paint.

13. The method as claimed in claim 1, wherein the electrically conductive surface coating is applied to the whole or parts of the burning surfaces of the propellant charge as a glue.

14. The method as claimed in claim 1, wherein when the ambient temperature is disadvantageous, this disadvantageous temperature is compensated by increasing or decreasing the supplied electrical energy in accordance therewith.

15. The method as claimed in claim 1, wherein the electrically conductive surface coating is applied to the whole or parts of the burning surfaces of the propellant charge as an epoxy-based conductive copper coating.

* * * * *